US005354254A

United States Patent [19]

Zabriskie et al.

[11] Patent Number: 5,354,254

[45] Date of Patent: Oct. 11, 1994

[54] CENTRIFUGE ROTOR HEAD WITH TUBE NECK SUPPORT

[75] Inventors: B. Dale Zabriskie, Longwood; Randall L. Morrison, Oviedo, both of Fla.

[73] Assignee: Separation Technology, Inc., Altamonte Springs, Fla.

[21] Appl. No.: 47,748

[22] Filed: Apr. 15, 1993

[51] Int. Cl.[5] ..... B04B 7/06; B04B 5/02

[52] U.S. Cl. ..... 494/12; 494/16

[58] Field of Search ..... 494/12, 16, 19, 20, 494/31, 33, 43, 81, 85; 422/72; 74/572, 573 R, 574

[56] References Cited

U.S. PATENT DOCUMENTS

| | | | |
|---|---|---|---|
| 3,133,882 | 5/1964 | Mitchell et al. | 494/16 |
| 3,439,871 | 4/1969 | Unger | 494/16 X |
| 4,221,325 | 9/1980 | Kubota | 494/16 |
| 4,460,351 | 7/1984 | Wakita et al. | 494/16 |
| 4,509,940 | 4/1985 | Romanauskas | 494/16 |
| 4,553,955 | 11/1985 | Lam et al. | 494/16 |
| 4,738,655 | 4/1988 | Brimhall et al. | 494/10 |
| 4,801,290 | 1/1989 | Gunter | 494/16 |
| 4,944,721 | 7/1990 | Carson | 494/16 |
| 5,232,432 | 8/1993 | Eberle | 494/16 |

FOREIGN PATENT DOCUMENTS

| | | | |
|---|---|---|---|
| 3343846 | 6/1985 | Fed. Rep. of Germany | 494/16 |
| 4014440 | 7/1991 | Fed. Rep. of Germany | 494/16 |
| 2098516 | 11/1982 | United Kingdom | 494/16 |

*Primary Examiner*—Timothy F. Simone
*Assistant Examiner*—Charles Cooley
*Attorney, Agent, or Firm*—Warren L. Franz; James H. Beusse

[57] ABSTRACT

A centrifuge rotor head has a hollow frusto-conical housing with parallel inner and outer, upwardly and inwardly inclined walls joined at top and base ends by top and bottom annular flanges, and closed at the top by a central horizontally extending disc portion. The top flange is interrupted at equiangularly spaced intervals by circular openings which, together with an internal annular chamber, present steep angled cavities making angles of about 20° with the rotor cone axis. The housing is capped at its upper end by a circumferentially-extending crown-shaped ring which has a plurality of upwardly and inwardly inclined projections located radially outward of the openings. The projections support the exposed upper ends of tubes placed in the cavities, to guard against neck breakage and stopper dislodgement during spinning.

19 Claims, 1 Drawing Sheet

CENTRIFUGE ROTOR HEAD WITH TUBE NECK SUPPORT

This invention relates to centrifuges, in general; and, in particular, to a centrifuge rotor head having means for supporting the necks and stoppers of tubes to guard against breakage or leakage during near vertical spinning.

BACKGROUND OF THE INVENTION

The use of centrifuges is common in hematology for the preparation and spinning of plasma and serum blood samples. Centrifugation causes the incrementally more dense red blood cells to separate out from the remaining plasma. This is useful for determining the packed cell volume hematocrit value of whole blood, as well as for determining coagulation related and other hematological parameters.

A conventional hematology associated centrifuge comprises a rotor head mounted on a vertical drive shaft, extending upwardly from an electrical motor assembly housed within a base. The head typically takes the form of a body of rotation having a centrally disposed hub portion and an annular portion. The hub portion serves to mount the head for rotation on the drive shaft. The annular portion defines a plurality of cavities or sockets that, either directly or indirectly through the use of fixed or "swinging bucket" adapter sleeves, provide open-topped receptacles for holding a corresponding plurality of sample tubes during spinning. For sake of balance, the cavities are equiangularly spaced about the rotational axis of the head. In order to facilitate insertion and removal, cavity lengths are preferably matched to tube standard body lengths so that the necks of the tubes protrude out from the cavity openings when the tubes are fully inserted.

Following traditional teachings, prior art centrifuge devices have cavities oriented either horizontally or at angles of about 45° with respect to the rotational axis. It has, however, been recognized in connection with the centrifugation of microhematocrit capillary tubes for determination of packed cell volume, that the rate of migration of red blood cells from plasma can be increased by orienting the tubes almost vertically, at angles of about 20° to the rotor axis (70° to the horizontal plane of the hub portion). The benefits to be obtained from such steep angling are discussed in Brimhall et al. U.S. Pat. No. 4,738,655. The extension of such steep angling to larger tubes, though, is subject to several disadvantages. The tubes are subject to increased risk of breakage, especially at the cavity opening/tube neck interface, due to greater cross-axial forces applied to the tubes. There is also an increased risk of stopper dislodgement due to greater cross-axial forces applied to the stoppers. This results in an attendant increase in the risk of contamination due to biohazardous material.

SUMMARY OF THE INVENTION

It is an object of the present invention to extend the benefits of steep angle centrifugation to exposed tube neck centrifuges, while minimizing increases in the risk of breakage due to accompanying increases in cross-axial forces.

It is a further object of the invention to provide a centrifuge rotor head, giving support to necks and stoppers of tubes received in cavities for spinning, without unduly interfering with neck graspability or stopper viewability.

It is yet another object of the invention to provide an improved centrifuge rotor head, featuring a crown-shaped ring having angularly-spaced, upwardly and inwardly inclined projections for supporting the exposed necks of tubes and guarding against dislodgement of stoppers during spinning.

In one aspect of the invention, a centrifuge rotor head suitable for blood sample centrifugation takes the form of a hollow frusto-conical housing, defining a plurality of steeply-angled tube-receiving cavities and including a corresponding plurality of circumferentially angularly-spaced, upwardly and inwardly inclined projections which serve as abutment supports for counteracting forces applied crossaxially at exposed tops of the tubes during centrifugation.

An illustrated embodiment of the invention, described in detail below, comprises a unitary rotor head having three mated parts: a rotor housing top, a rotor housing bottom and a crown-shaped tube neck support ring attached peripherally about the rotor housing top and configured with alternating upwardly and inwardly inclined projections and voids. A similar head can be constructed as an integral, one-piece member.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
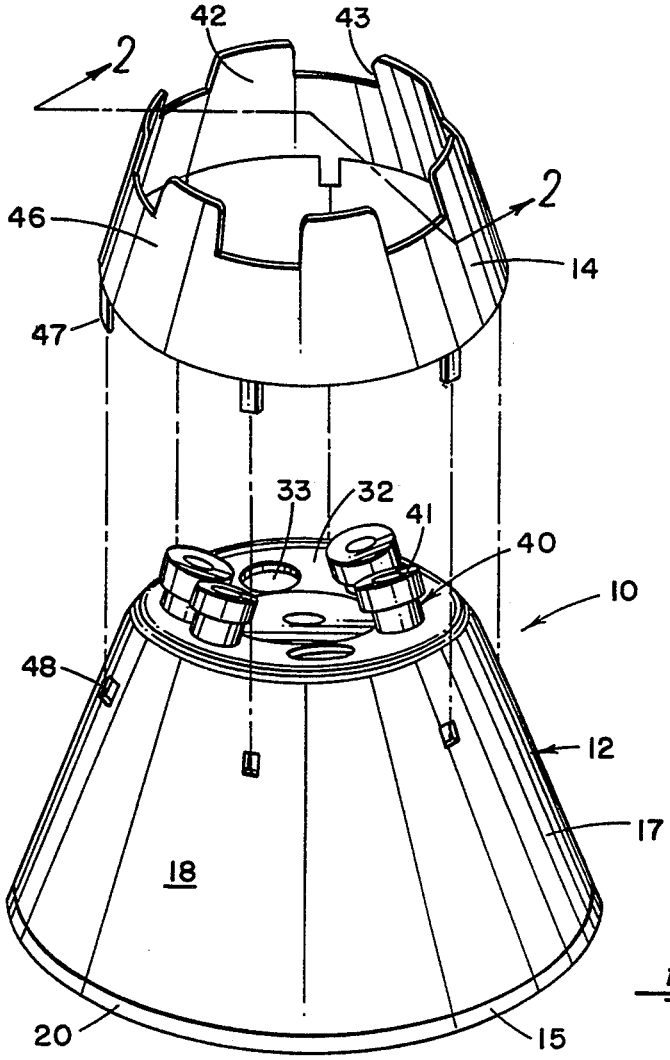
FIG. 1 is an exploded perspective view of a centrifuge rotor head in accordance with the invention, suitable for the centrifugation of stoppered sample tubes in hematology.
Figure 2:
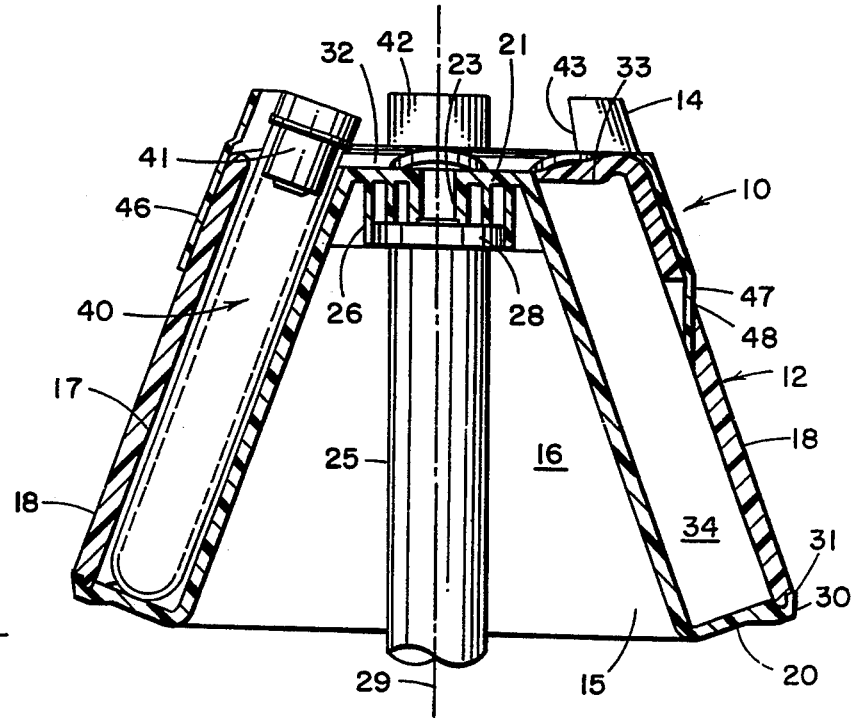
FIG. 2 is a cross-section view taken along the line 2—2 of the assembled rotor head of FIG. 1.

As shown in FIGS. 1 and 2, a centrifuge rotor head 10, in accordance with the invention, has a hollow frusto-conical housing 12, capped at its upper end by a circumferentially-extending crown-shaped ring 14.

The housing 12 comprises a bottom portion 15 defining an inner, upwardly and inwardly inclined frusto-conical wall 16, and a top portion 17 defining an outer, upwardly and inwardly inclined, frusto-conical wall 18. Inner and outer walls 16 and 18 of housing 12 are parallel. The bottom portion 15 includes, at its base, a circular flange 20, directed upwardly and outwardly, circumferentially about the lower edge of wall 16, at right angles to wall 16. Portion 15 also includes a central, horizontally extending disc portion 21 at its top that closes off the top end of the hollow, truncated cone formed by wall 16.

Disc portion 21 includes a central vertical bore 23, coaxial with a corresponding bore (not shown) of a vertical drive shaft 25 (FIG. 2) of a conventional electrical drive motor unit (not shown). The underside of disc 21 may include a keying means such as a series of parallel positioning ribs 26 for mating the underside of the disc concentrically with the contour of a parallel, vertically extending mounting plate 28 attached at the upper end of shaft 25. A threaded fastener (not shown) is passed through the aligned bores of disc 21 and shaft 25 to releasably lock the housing 12 concentrically about the shaft 25, so that the housing centerline 29 is coincident with the rotary axis of motor shaft 25.

The upper surface of flange 20 includes a peripheral circular groove 30 into which a complementary circular ridge 31 located along the base edge of wall 18, is matingly received. The portion 17 includes at its top another circular flange 32, directed downwardly and inwardly to fill the annular gap at the top of housing 12, between the top of wall 16 and the top of wall 18. Flange 32 extends generally parallel to flange 20, but is rounded for smoothness of contour and aesthetic appearance. Flange 32 is, moreover, interrupted at equiangularly spaced intervals by circular openings 33 providing access to an internal chamber 34 formed between opposing surfaces of portions 15, 17. The openings 33 cooperate with the chamber 34 to present a plurality of upwardly and inwardly inclined channels or cavities into which a corresponding plurality of tubes 40 having stoppers 41 can be received, with their top, stoppered neck ends exposed above the openings 33.

In accordance with a feature of the present invention, the ring 14 includes a plurality of upwardly and inwardly inclined projections or shields 42, respectively arranged in one-to-one correspondence, radially outward of the openings 33. The projections 42 are made parallel with the wall 18, to continue the upward and inward contour thereof, up beyond the openings 33 to the tops of the stoppers 41 of tubes 40. The projections 42 are preferably separated by voids 43 which provide empty spaces between the projections that enable the necks of tubes 40 to be grasped without hindrance, except for a limited region of shielding located directly radially outward thereof.

In a suitable arrangement, the portions 14, 15 and 17 are dimensioned, configured and adapted to match the dimensions of standard 10 ml (16×100 mm) stoppered tubes 40, so that the tubes 40 may be coaxially received within the rotor head cavities, with the tops of stoppers 41 in line with the tops of the projections 42 when tubes 40 are fully inserted into the chamber 34 through the respective openings 33. The walls 16, 18 are sloped to define cavities of like slope making angles of about 20° with the rotation axis coincident with center line 29 of head 10. The openings are matched to the circumferences of tubes 40, and the axial lengths of the cavities (distances from openings 33 to flange 20) are matched to the non-exposed lengths, below the necks, of tubes 40.

The illustrated embodiment has six uniformly circumferentially equiangularly spaced cavities, with corresponding six uniformly circumferentially equiangularly spaced projections or shields 42 of ring 14, and six intervening voids 43. For a suggested arrangement, adjacent openings 33 are spaced by 60° angles about he flange 32, and projections 42 are likewise spaced by 60° angles. A suitable configuration has each projection spanning an approximately 30° arc, followed by an arcuate void of a like 30°. To match the angling of the cavities, each projection 42 is angled upwardly and inwardly at an angle of 20° to vertical. The illustrated arrangement has the projections 42 formed between voids at the upper part of a frusto-conical main body portion 46, dimensioned to abut the external surface of wall 18 at the top of housing 12. Six circumferentially equiangularly spaced tabs 47 depend vertically from the bottom edge of ring 14, and are inserted into corresponding vertical tapered openings 48 formed in the wall 18.

In one mode of fabrication, the three parts 14, 15 and 17 of the assembly 10 are formed as separate injection-molded plastic parts, then ultrasonically welded together to form an inseparable, integrated whole. Such unitary bonding not only increases the overall rigidity of the finished structure, but improves system safety by sealing chamber 34 for containment of material, should spillage occur during centrifugation, and by preventing operator disassembly. Injection molding or similar means is suggested to achieve lightweight plastic parts for weight conservation, thereby improving the overall life expectancy of the motor. The suggested embodiment provides steep angled cavities dimensioned to accommodate the 10 ml (16×100 mm) tubes without adapter sleeves, and 2 ml, 3 ml, 5 ml and 7 ml tubes using adapters.

A rotor head in accordance with the invention, as described above, provides the advantages of steeply angled centrifugation, while minimizing undesirable effects associated with increased cross-axial forces exerted on the tube necks and stoppers. During centrifugation, the top ends of the tubes remain exposed above the openings 33 for ease of handling during insertion and removal, and for unobstructed viewing to verify stopper integrity. The projections 42 provide backup shields against which the tube necks and stoppers can abut for support and protection against breakage and stopper dislodgement. By virtue of the voids 43, the advantages of the projections 42 are attainable, without undue loss of gripping space.

Whether stoppered or unstoppered tubes are used, a rotor head constructed in accordance with the invention will provide benefits over prior art configurations, especially for near vertical centrifugation. Those skilled in the art to which the invention relates will appreciate that, though the projections 42 are illustrated as part of a separate crown-shaped ring, the same advantages can be realized by forming backup support elements directly as part of the main body of housing 12 itself, and that housing 12 can be formed in a single rather than multiple piece construction. Also, while the chamber 34 interconnects the respective cavities defined by openings 33, it should be understood that the same principles are applicable for a head having individual, isolated cavities. Thus, an alternative mode of implementation, for example, provides the crown-shaped ring and housing as a single, integral molded or machined hollow conical unit, with cavities formed by individual angularly distributed, upwardly and inwardly sloping bores. It will also be realized that yet other substitutions and modifications can be made to the described embodiments, without departing from the spirit and scope of the invention as described by the claims below.

What is claimed is:

1. In a rotor head for a centrifuge having a vertical drive shaft; said rotor head comprising a body having a top, a rotor axis, a centrally disposed hub portion, an annular portion depending peripherally from said hub portion, means located on said hub portion for mounting said head to said drive shaft for rotation about said rotor axis, and a plurality of cavities formed in said body at angular spacings about said rotor axis, said cavities having top openings and being dimensioned for receiving a corresponding plurality of sample tubes respectively therein, so that necks of the tubes protrude out from said cavity openings when the tubes are fully inserted, the improvement comprising:

said body comprising a hollow frusto-conical body and a central disc portion closing off said conical body at said top;

said annular portion having an outer wall inclined upwardly and inwardly toward said rotor axis;

said cavities being formed in said body at orientations likewise inclined upwardly and inwardly toward said rotor axis; and said rotor head further including a crown-shaped configuration of circumferentially angularly-spaced alternating projections and voids at the top of said body; said projections being directed upwardly beyond said openings and being dimensioned, configured and adapted for abuttingly supporting said tube necks during centrifugation; and said voids being dimensioned, configured and adapted to provide empty spaces between said projections for enabling said tube necks to be grasped for insertion of said tubes into, and removal of said tubes from, said cavity openings.

2. The improvement of claim 1, wherein said cavities are angled at angles of about 20° relative to said rotor axis.

3. The improvement of claim 1, wherein said projections are inclined upwardly and inwardly toward said rotor axis with the same inclination as said outer wall.

4. The improvement of claim 3, wherein said rotor head further comprises a ring, said ring having a frusto-conical body portion annularly positioned relative to said wall, and said projections are formed on said ring to extend up from said body portion to present said crown shaped configuration.

5. The improvement of claim 1, wherein said rotor head includes n cavities equiangularly spaced about said rotor axis, and said projections comprise corresponding n projections which are respectively separated by said voids and which are equiangularly spaced about said rotor axis in correspondence with said cavities.

6. The improvement of claim 5, wherein said projections span arcs of angles defined by 360°/2n.

7. The improvement of claim 6, wherein said cavities are dimensioned to match corresponding dimensions of standard stoppered tubes, and said projections have tops dimensioned to be in alignment with the tops of said tubes when said tubes are fully inserted within said cavities.

8. A rotor head for a centrifuge having a drive shaft rotatable about a rotational axis, said rotor head comprising a body having a rotor axis; means for mounting said body on said drive shaft with said rotor axis coincident with said rotational axis; means, on said body, defining a plurality of open-topped cavities inclined upwardly and inwardly toward said rotor axis and located at angularly-spaced intervals about said rotor axis; and means, for supporting exposed tops of tubes placed in said cavities against forces exerted on said tops during rotation of said rotor head by said shaft about said rotor axis, said means for supporting; comprising a crown-shaped configuration of alternating projections and voids; said projections being respectively located radially outwardly of said plurality of cavities, and said voids providing empty spaces between said projections for enabling said tube tops to be grasped for insertion and removal of said tubes.

9. The rotor head of claim 8, wherein said means defining said cavities defines cavities upwardly and inwardly inclined at angles of about 20° relative to said rotor axis.

10. A rotor head for a centrifuge having a drive shaft rotatable about a rotational axis, said rotor head comprising:

a hollow frusto-conical housing assembly having a rotor axis and an upper end, said housing defining a plurality of cavities inclined upwardly and inwardly toward said rotor axis, said cavities having openings at said upper end for receiving a corresponding plurality of tubes therein, with neck ends of the tubes exposed above said openings;

a crown-shaped ring, circumferentially extending about said housing and including portions separated by voids and extending upward beyond said upper end; said extending portions being dimensioned, configured and adapted for providing support for said exposed neck ends at positions located radially outwardly of said openings; and said voids being dimensioned, configured and adapted for providing empty spaces between said projections for enabling said tube neck ends to be grasped; and means for mounting said housing on the shaft with said rotor axis coincident with said rotational axis.

11. A rotor head for a centrifuge having a drive shaft rotatable about a rotational axis, said head comprising:

a housing having a rotor axis and including a bottom housing portion defining an inner frusto-conical wall, said inner wall having a top and a base and being inclined upwardly and inwardly toward said rotor axis; a top housing portion defining an outer frusto-conical wall, said outer wall having a top and a base and being inclined upwardly and inwardly toward said rotor axis; and first and second flange members respectively joining said tops and bases of said inner and outer walls, for fixing said walls in parallel positions about said rotor axis and defining an annular internal chamber therebetween;

means, located centrally at said top of said inner wall, for mounting said housing on the shaft with said rotor axis coincident with said rotational axis;

means located on said first flange member for defining, with said chamber, a plurality of cavities inclined upwardly and inwardly toward said rotor axis, said cavities housing circular top openings and being parallel to said inner and outer walls and into which a corresponding plurality of sample tubes can be received; and a crown-shaped ring extending circumferentially about the top of said outer wall and including a plurality of circumferentially angularly-spaced alternating projections and voids, said projections extending upward beyond said circular openings and said voids providing empty spaces between said projections.

12. The rotor head of claim 11, wherein said cavities are angled at about 20° with respect to said rotor axis.

13. The rotor head of claim 11, wherein said first and second flange members comprise first and second circular flanges directed at generally right angles to said walls.

14. The rotor head of claim 13, wherein said means for defining said cavities comprises said first flange being interrupted at equiangularly spaced intervals by said circular openings providing access to said internal chamber.

15. The rotor head of claim 14, wherein said first flange is directed downwardly and inwardly from the top of said outer wall toward said rotor axis; said second flange is directed upwardly and outwardly from the base of said inner wall away from said rotor axis; and said first and second flanges are permanently bonded, respectively, to said inner wall top and to said outer wall base, so that said chamber is sealed except at said circular openings.

16. The rotor head of claim 15, wherein said second flange has an upper surface including a peripheral circular groove, said base of said outer wall includes a complementary circular ridge, and said ridge is bonded within said groove.

17. The rotor head of claim 11, wherein said projections are directed upwardly and inwardly toward said rotor axis, and said ring is permanently bonded to said top housing portion, with said projections continuing the upward and inward contour of said outer wall.

18. The rotor head of claim 17, having n cavities, and n projections respectively located radially outwardly of said n cavities.

19. The rotor head of claim 18, wherein said projections span arcs of angles defined by 360°/2n; and said cavities are inclined at about 20° relative to said rotor axis.

* * * * *